US006040736A

United States Patent [19]

Milanesi et al.

[11] Patent Number: 6,040,736

[45] Date of Patent: Mar. 21, 2000

[54] CONTROL CIRCUIT FOR POWER TRANSISTORS IN A VOLTAGE REGULATOR

[75] Inventors: Andrea Milanesi, Casalnoceto; Vanni Poletto, Casale Monferrato; Alberto Poma, Pavia; Marco Morelli, Leghorn, all of Italy

[73] Assignees: SGS-Thomson Microelectronics S.r.l., Arate Brianza, Italy; Magneti Marelli S.p.A., Milan, Italy

[21] Appl. No.: 08/984,959

[22] Filed: Dec. 4, 1997

[30] Foreign Application Priority Data

Dec. 5, 1996 [EP] European Pat. Off. ..... 96830610

[51] Int. Cl.[7] ..... G05F 1/10

[52] U.S. Cl. ..... 327/541; 327/540; 323/316

[58] Field of Search ..... 327/535, 533, 327/540, 541; 323/313, 316

[56] References Cited

U.S. PATENT DOCUMENTS

| | | | |
|---|---|---|---|
| 4,358,728 | 11/1982 | Hashimoto | 327/109 |
| 4,803,612 | 2/1989 | Skovmand . | |
| 5,191,278 | 3/1993 | Carpenter . | |
| 5,365,118 | 11/1994 | Wilcox | 327/109 |
| 5,404,053 | 4/1995 | Poma et al. | 327/108 |
| 5,412,309 | 5/1995 | Ueunten | 323/316 |
| 5,552,697 | 9/1996 | Chan . | |
| 5,721,485 | 2/1998 | Hsu et al. | 327/540 |
| 5,910,924 | 6/1999 | Tanaka et al. | 365/226 |

FOREIGN PATENT DOCUMENTS

| | | |
|---|---|---|
| 0379454 | 7/1990 | European Pat. Off. . |
| 0476365 | 3/1992 | European Pat. Off. . |
| 0499921 | 8/1992 | European Pat. Off. . |
| WO 95/27239 | 10/1995 | WIPO . |

OTHER PUBLICATIONS

Walt Jung and James Wong, "Analog Circuits Bypass Single Supply Design Constraints," *Electrical Design News* , Jun. 10, 1993, pp. 137–148.

*Primary Examiner*—Terry D. Cunningham
*Attorney, Agent, or Firm*—Theodore E. Galanthay; Allen, Dyer, Doppelt, Milbrath & Gilchrist, P.A.

[57] ABSTRACT

A voltage-regulator circuit with a low voltage drop uses a DMOS power transistor driven by a charge pump. The control circuit includes two feedback loops: a first feedback loop having a high gain and accuracy but low response speed, and a second feedback loop having a wide passband and fast response speed, but low gain.

14 Claims, 5 Drawing Sheets

CONTROL CIRCUIT FOR POWER TRANSISTORS IN A VOLTAGE REGULATOR

FIELD OF THE INVENTION

The present invention relates, in general, to circuits for controlling power transistors in a voltage regulator. More specifically, this invention relates to a circuit for controlling power transistors in a linear voltage regulator with a low voltage drop.

BACKGROUND OF THE INVENTION

Currently, there is an ever greater need by the market for voltage regulators with low voltage drop, that is, regulators which can operate correctly even if the voltage drop between the supply voltage and the regulated output voltage is a fraction of a volt. These linear voltage regulators with low voltage drop are required for various reasons. For example, they improve efficiency in both battery-operated electronic systems and those operating with a mains supply. A regulator which supplies an output voltage of 5 V and needs a voltage drop of 5 V has an efficiency of 50% whereas, if it requires a voltage drop of only 0.5 V between the input and the output, its efficiency is more than 90%.

A reduction in the power dissipated by the regulator avoids the use of large dissipaters and enables less expensive housings to be used. A regulator which requires a voltage drop of 5 V when it is supplying a current of 1 A to the load has to dissipate a power of 5 W. In contrast, with a voltage drop of 0.5 V, it has to dissipate only 0.5 W. The reduction in the dimensions of the dissipater, or its elimination, and the reduction in the dimensions of the transformer (in mains applications) also permits a considerable saving of space.

The continual reduction of the supply voltages of electronic devices with the consequent spread of systems with a mixed 5 V and 3.3 V supply (the latter can be produced from the former simply by a regulator with a low voltage drop) necessitates the use of regulators of this type. Moreover, these regulators supply a constant voltage to the load even in motor vehicle applications in which the voltage supplied by the battery may fluctuate considerably because of changes in temperature or in the load currents. An example is the starting of the motor vehicle at low temperature, during which the battery voltage may fall to values slightly more than 5 V.

The element around which a voltage regulator is constructed may be a bipolar transistor or a MOS power transistor. In the first case, the minimum voltage drop is given by the saturation voltage $V_{sat}$ of the transistor. In the second case, the minimum voltage drop between input and output is related to the voltage Vgs supplied between the gate and source terminals and to the physical size of the transistor, and the voltage drop could thus be reduced even to a few tens of millivolts. Another advantage of MOS transistors, for example, those of DMOS type, is the smaller area of silicon occupied.

However, problems arise if it is attempted to produce a wholly integrated regulator which minimizes or reduces to zero the number of external components necessary for the regulator to be functional and stable and to have a rapid response to changes in the voltage regulated, with performance comparable to or better than normal regulators without a low drop. One of the main problems is that the gate voltage of the MOS transistor has to be brought to high values, usually to a voltage greater than the supply voltage.

Approaches according to the prior art use a charge pump to generate a voltage high enough to be able to drive the MOS power transistor. A circuit of this type is shown in FIG. 1. The voltage-regulator circuit shown uses a charge pump CP which supplies a voltage greater than that provided at an input IN of the voltage regulator. This voltage supplied by the charge pump CP supplies an output stage BUF of an error amplifier ERA which in turn controls a gate terminal of a power transistor PT.

The other main terminals of the voltage regulator are also indicated in FIG. 1. Thus, the output terminal OUT, the ground terminal GND and the adjustment terminal ADJ can be seen. As can be noted, the control loop of the voltage regulator is conventional, the non-inverting and inverting inputs of the error amplifier ERA being connected to a band-gap voltage reference BG and to the adjustment terminal ADJ, respectively. The drawing also shows a fold-back protection circuit FB. The other parts of the circuit of FIG. 1 are not described since they are not relevant for the purposes of the present invention.

SUMMARY OF THE INVENTION

The object of the present invention is to provide a linear voltage-regulator circuit with a low voltage drop which solves the problems indicated above in a satisfactory manner.

According to the present invention, this object is achieved by means of a linear voltage-regulator circuit with a low drop comprising a power transistor which is supplied with an input voltage for regulating an output voltage, and a voltage-raising circuit which is supplied with the input voltage for driving a control terminal of the power transistor. The voltage-raising circuit operates based upon a difference between a signal indicative of the output voltage and a reference voltage. Moreover, the regulator circuit includes a closed feedback control circuit cooperating with the power transistor and the voltage-raising circuit for defining a first feedback loop having high gain and low response speed, and a second feedback loop having low gain, wide passband, and quick response speed.

In one embodiment, the first feedback loop may be provided by a resistive divider for detecting the signal indicative of the output voltage; a first amplifier having a first input connected to the resistive divider and a second input connected to the reference voltage; and a second amplifier having an input connected to the output of the first amplifier and an output connected to the voltage-raising circuit. In this embodiment, the second feedback loop may comprise a capacitor connected between the output of the first amplifier and a control terminal of the power transistor.

In a second embodiment, the first feedback loop preferably comprises a resistive divider for detecting the signal indicative of the output voltage; and an operational amplifier having a first input connected to the resistive divider, a second input connected to the reference voltage, and an output connected to the voltage-raising circuit. In this embodiment, the second feedback loop may further comprise a capacitor connected between the output of the operational amplifier and a control terminal of the power transistor; and a further capacitor connected between the resistive divider and the output of the operational amplifier. In addition, the second feedback loop may also include a further resistor connected in series with the further capacitor.

BRIEF DESCRIPTION OF THE DRAWINGS

Further advantages and characteristics of the present invention will become clear from the following detailed description, given with the aid of the appended drawings, provided by way of non-limiting example, in which.

DETAILED DESCRIPTION OF THE PREFERRED EMBODIMENTS

Figure 1:
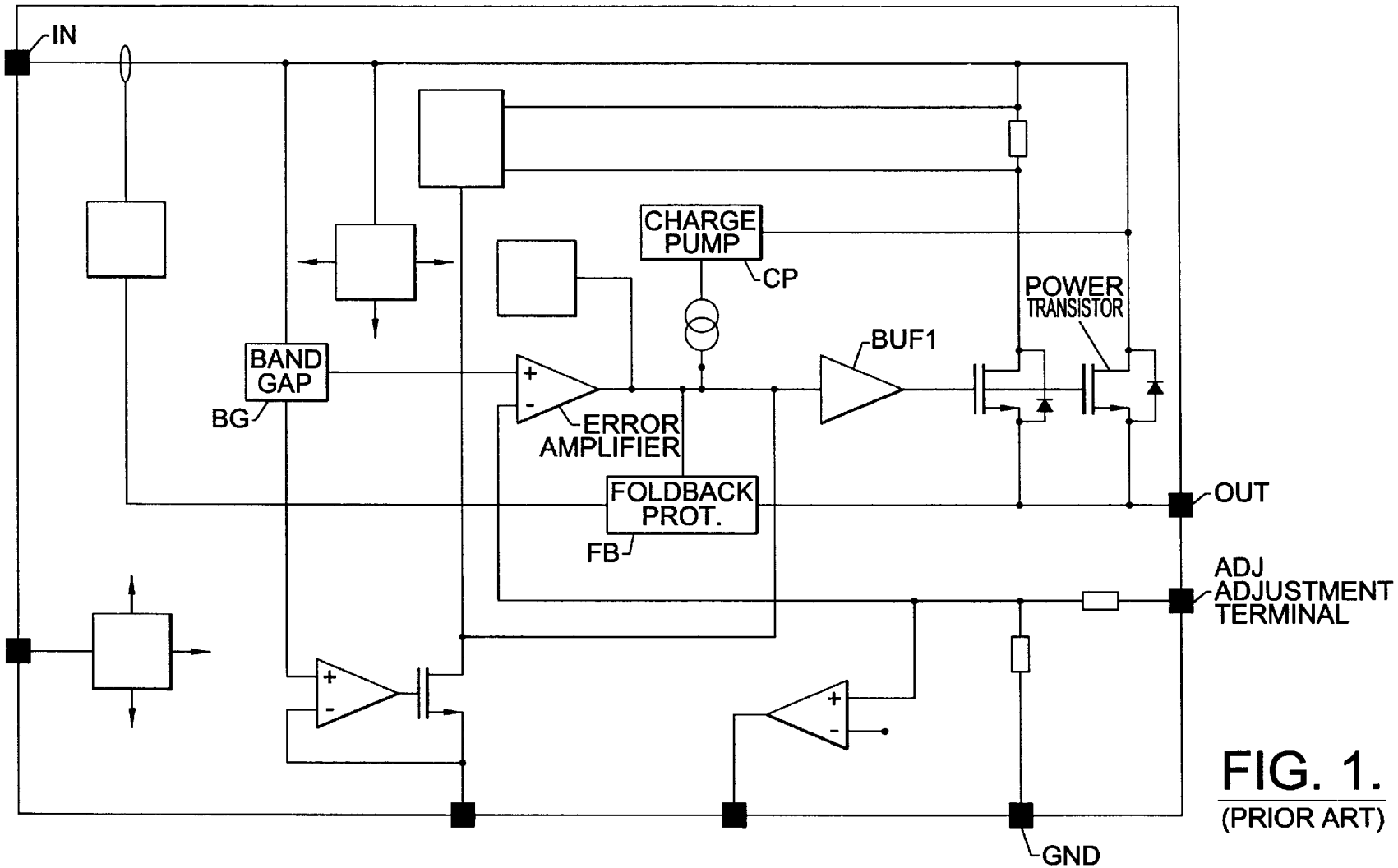
FIG. 1. (PRIOR ART)
FIG. 1 is a diagram of a circuit according to the prior art and has already been described.
Figure 2:
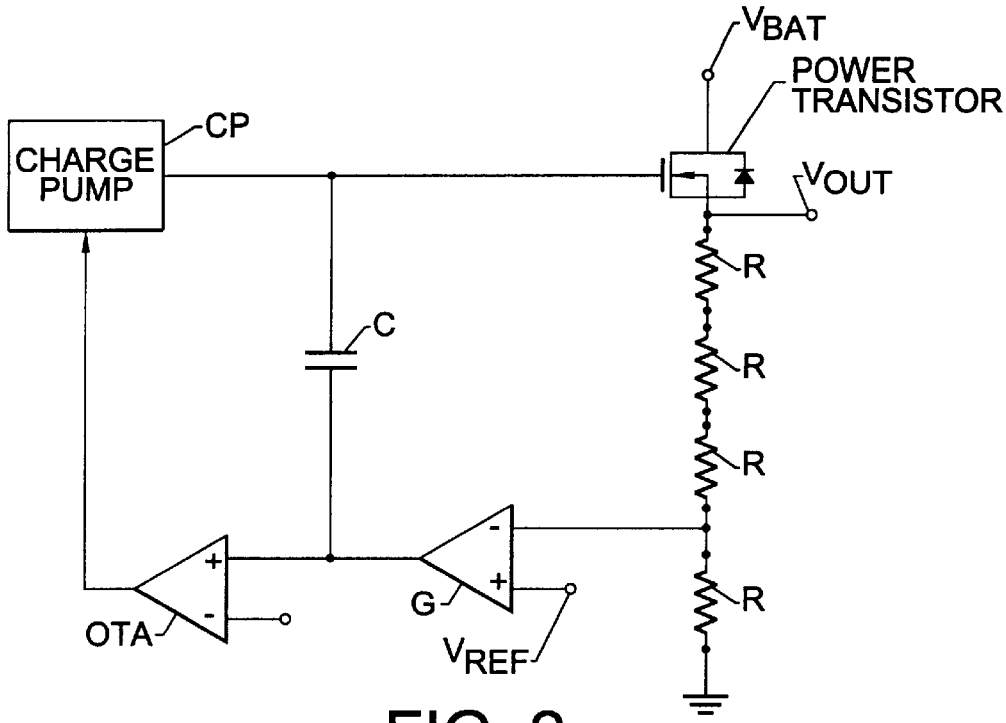
FIGS. 2 to 4 are diagrams of three alternative embodiments of the circuit according to the invention.

A simplified diagram of the voltage regulator according to the invention is shown in FIG. 2. As can be seen, the circuit shown in FIG. 2 comprises a power transistor PT, for example, a DMOS transistor, supplied by an input voltage VBAT and having the function of regulating an output Vout in a manner such that it adopts a predetermined value. As in the prior art, the gate terminal of the power transistor PT is driven directly by a charge pump CP.

Naturally, the circuit operates with a closed loop using, as the feedback signal, a signal indicative of the output voltage Vout obtained by means of a resistive divider provided by the four resistors R interposed between the output and the ground of the circuit. This signal, which is indicative of the output voltage Vout, is compared with a predetermined reference voltage Vref to generate a control signal for the gate terminal of the power transistor PT according to a conventional layout for closed-loop regulation systems.

The other elements which make up the feedback loop are two amplifiers OTA and G and a capacitor C. The operation of this feedback loop, which differs from the circuits of the prior art, will now be described.

To obtain the output voltage which, in the specific case is 5 V, the reference voltage Vref which, in the specific case is 1.25 V and is produced, for example, by means of a band-gap circuit, is multiplied by four with the use of the resistive divider provided by the four resistors R. The current of the MOS power transistor PT is controlled by means of double feedback loop: a first, direct-current feedback loop by means of the two amplifiers G, OTA in cascade and the charge pump CP; and a second frequency feedback loop provided by the first amplifier G and the capacitor C.

The voltage-regulator circuit according to the invention thus actually comprises two feedback loops. The first feedback loop comprises the power transistor PT, the resistive divider R, the first amplifier G, the second amplifier OTA, and the charge pump CP. The second feedback loop, on the other hand, comprises the power transistor PT, the resistive divider R, the first amplifier G, and the capacitor C.

The charge pump CP which may, for example, be a voltage tripler, is used to bring the gate terminal of the power transistor PT to voltages greater than the supply voltage VBAT. The current in the charge pump CP is controlled by the first feedback loop, that is, by means of the first amplifier OTA which is, for example, a transconductance operational amplifier. When the output voltage Vout is in the steady state, the second amplifier OTA no longer supplies current to the charge pump CP, which is turned off. The high loop gain of the first feedback loop leads to great precision in the regulation of the output voltage Vout.

To save silicon area, small capacitors may be used in the charge pump CP. In a circuit produced by the applicant, for example, they are of one order of magnitude lower than the parasitic capacitances of the DMOS transistor PT. The small current injected into the gate terminal by the charge pump CP, added to the high parasitic capacitances at the gate terminal of the DMOS transistor PT, creates a pole at a low frequency which renders the first feedback loop quite slow. This problem is solved by the second feedback loop.

The second feedback loop is provided by the first amplifier G which has a low gain and a wide bandwidth, and by the capacitor C. In this case, the loop gain is lower, but the wide bandwidth enables the amplifier G to react quickly to any variations of the output voltage Vout, injecting charge into the gate terminal, or absorbing it by means of the capacitor C. For the circuit to operate well, this capacitor C must be of a size such as to be of the same order of magnitude as the parasitic capacitances present at the gate terminal of the DMOS transistor PT. The gate voltage is thus quickly brought close to the correct value which it can then reach precisely by virtue of the slower contribution of the first feedback loop.

Figure 3:
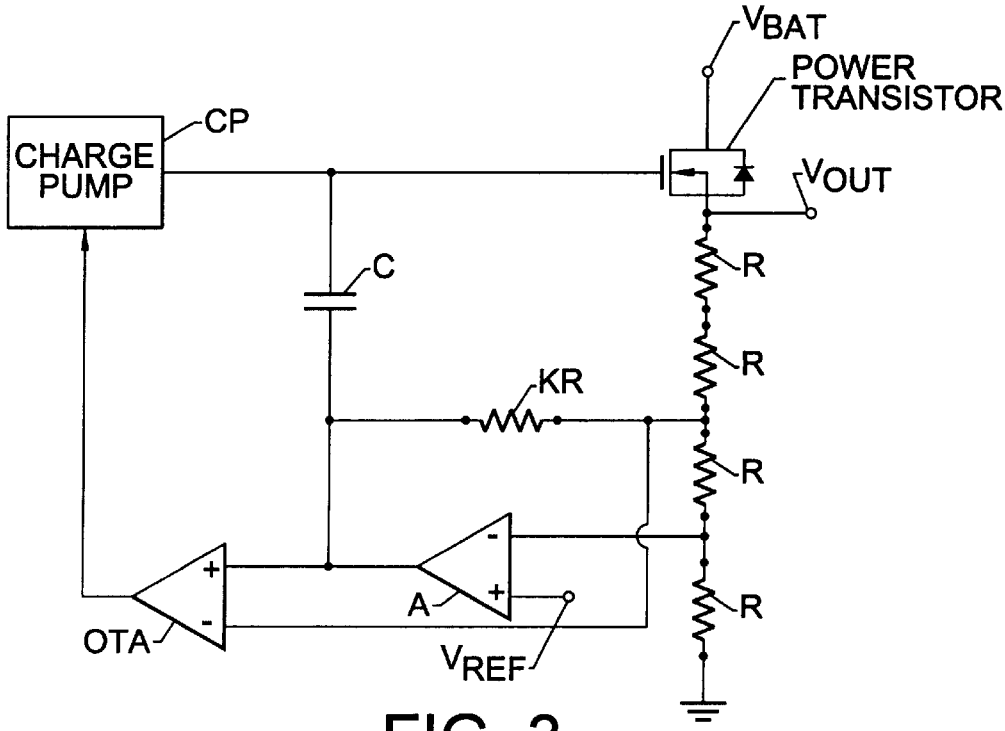

FIG. 3 shows an embodiment of the voltage-regulator circuit according to the invention in which a possible embodiment of the low-gain, wide passband amplifier is shown. The operational amplifier A used has a feedback network provided by two resistances of the output divider and by a resistor of value KR, where K is a constant.

In this configuration, the intermediate node of the divider behaves as a virtual ground at a voltage equal to 2 $V_{REF}$. Any departure of the output from its nominal value is amplified by a factor $$\frac{K}{2} = \frac{KR}{2R}$$

The relationship between this factor and the gain G of FIG. 2 is as follows:

$$\frac{K}{2} = \frac{G}{4} \qquad K = \frac{G}{2}$$

As can be seen, the inverting input of the second amplifier OTA is connected to a reference voltage such as to polarize the output of the amplifier A to a voltage 2 $V_{REF}$. In the steady state, the current passing through the resistor KR is thus zero and, in the specific embodiment, the output range of the amplifier A is maximized.

Figure 4:
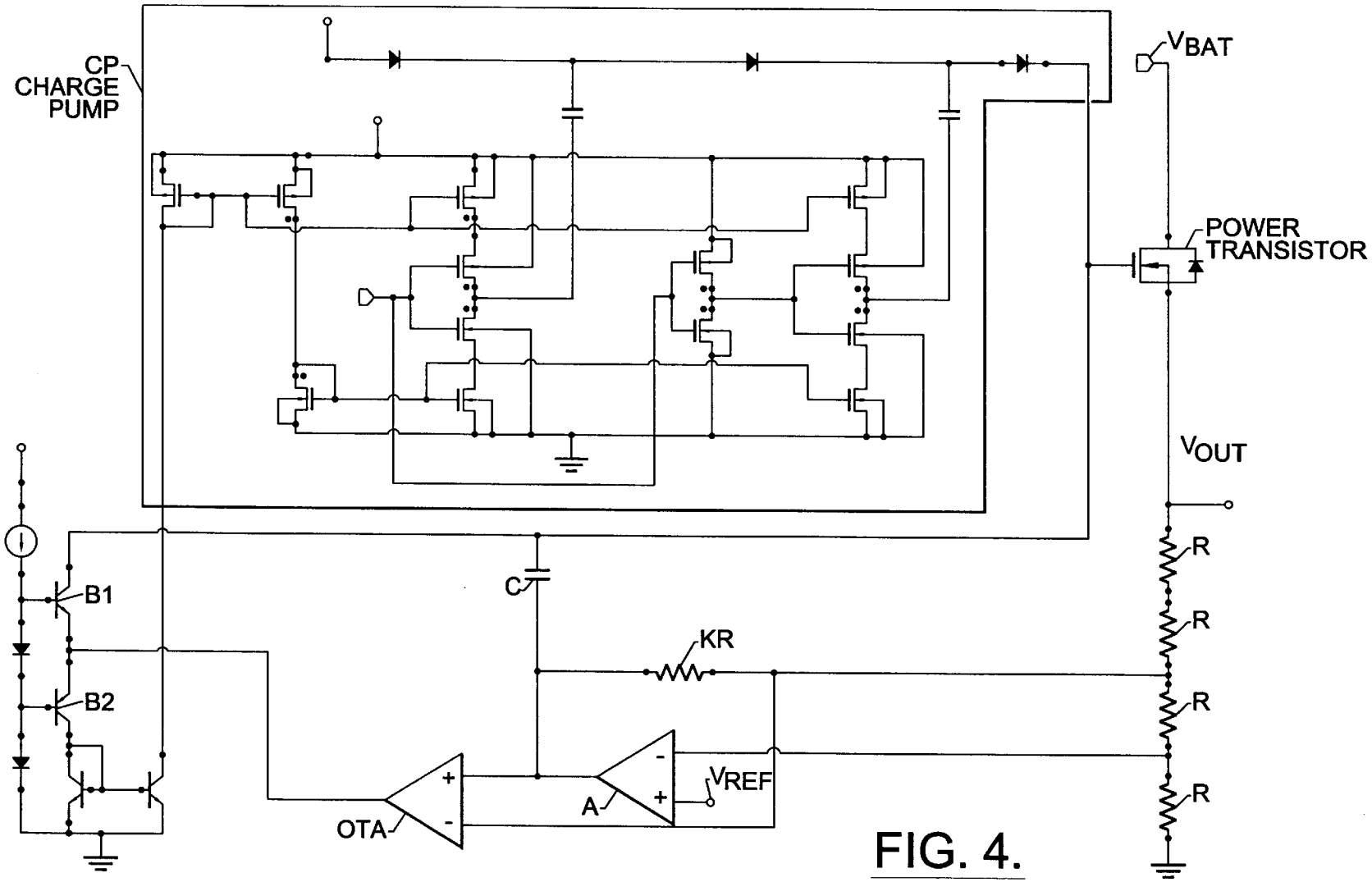

FIG. 4 is a detailed diagram of the current-control of the charge pump. The second amplifier OTA operates as a switch and two transistors Bl and B2 operate as current buffers. It should be noted that the latter are polarized in a manner such that when the output voltage Vout is in the steady state, they are both switched off and the current supplied to the charge pump CP or absorbed by the gate terminal of the DMOS transistor PT is zero.

The two feedback loops also ensure the stability of the circuit. The Bode diagram of the loop gain resulting from the combination of the two loops is given in FIG. 5. This diagram shows the loop gain |Av| of the circuit, expressed in dB, as a function of the frequency f, expressed in Hz.

The dominant pole $P_1$ is produced with the use of the parasitic capacitances of the DMOS power transistor PT. A second pole $P_2$ is given by the operational amplifier G. The circuit also has a zero $z_1$, which is important for compensating for a pole $P_{OUT}$ which is introduced by the load capacitance at the output and the frequency of which is shifted with variations of the current supplied by the regulator. In fact, the pole $P_{OUT}$ can be expressed as:

$$P_{OUT} = \frac{gm_{DMOS} + \frac{1}{R_{LOAD}}}{C_{LOAD}}$$

Where $C_{LOAD}$ and $R_{LOAD}$ are the load capacitance and resistance, respectively. Owing to the large dimensions of the DMOS transistor PT, $gm_{DMOS} >> 1/R_{LOAD}$ and, as a first approximation, the pole $P_{OUT}$ can thus be expressed as:

$$P_{OUT} \cong \frac{gm_{DMOS}}{C_{LOAD}}$$

Figure 5:
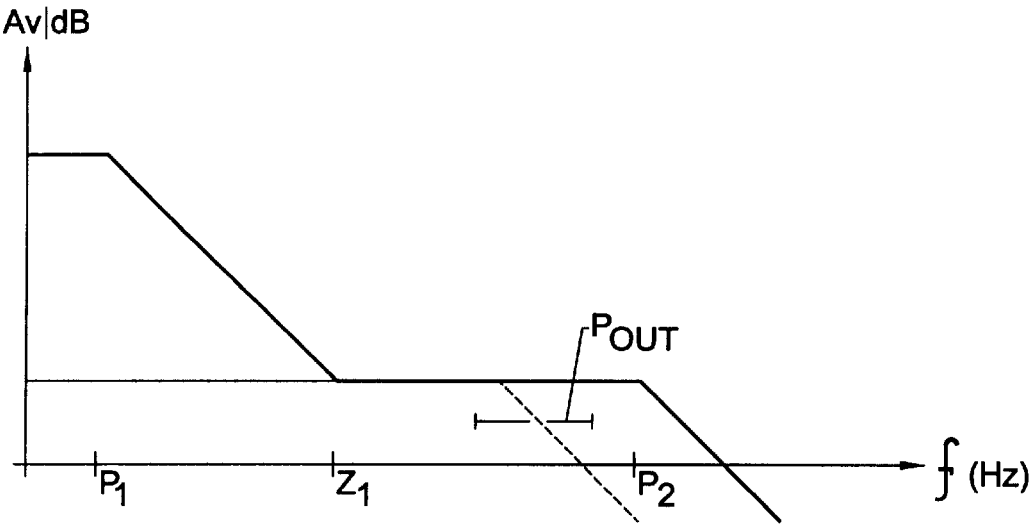
FIG. 5 is a graph showing the operation of the circuits shown in FIGS. 2 to 4.

When the pole $P_{OUT}$ varies, the loop gain is modified as indicated by the broken line in FIG. 5. If the pole $P_{OUT}$ coincides with one of the singularities $z_1$ or $p_2$, it is necessary to ensure a phase margin which is adequate for the stability of the circuit by accurate dimensioning of the feedback resistor KR. In doing this, it is necessary also to bear in mind the capacitive divider provided by the capacitor C and by the parasitic capacitances of the DMOS power transistor PT which lead to an attenuation of the loop gain, possibly of more than 10 dB.

Figure 6:
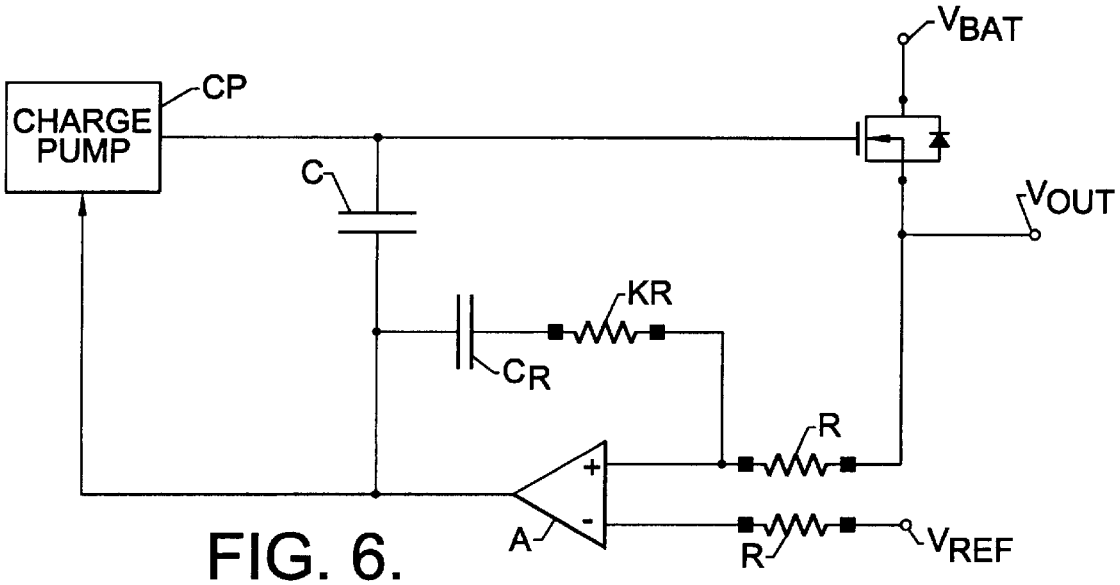
FIG. 6 is a diagram of a further alternative embodiment of the circuit according to the invention.

FIG. 6 is a simplified diagram of an alternative embodiment of the circuit. The charge pump CP and the capacitor C are used in a similar manner. The differences lie in the feedback look which is formed by a single operational amplifier A which controls both the feedback capacitor C and the current supplied by the charge pump CP. In this embodiment, the same operational amplifier A provides both the high direct-current gain and the low gain and wide passband at high frequency. To polarize the output of the operational amplifier A to a voltage of Vref/2 and to introduce the frequency zero $z_1$, it was necessary to add a further capacitor $C_R$.

Figure 7:
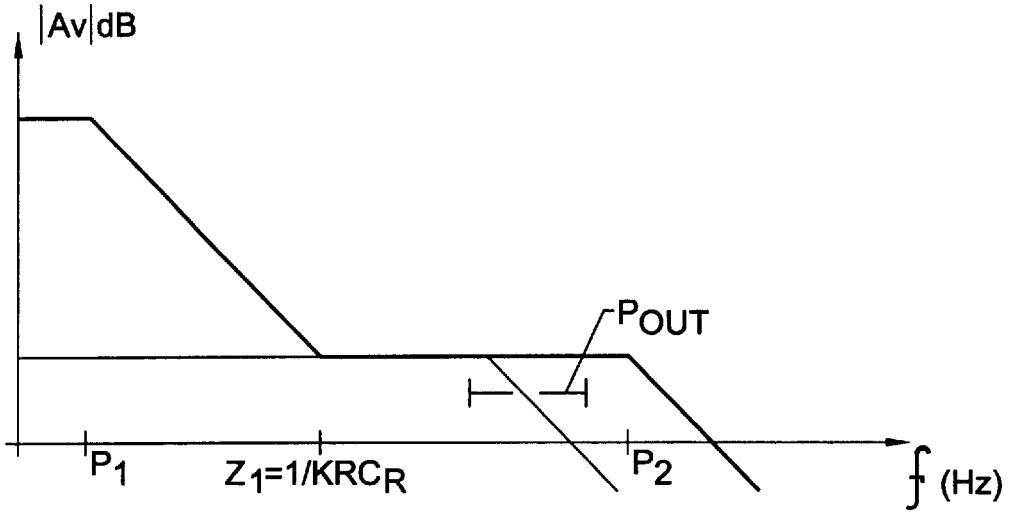
FIG. 7 is a graph showing the operation of the circuit shown in FIG. 6.

In this embodiment, the two feedback loops also ensure stability of the circuit, the Bode diagram of the loop gain resulting from the combination of the two loops is given in FIG. 7. In this case, the zero $Z_1$ is introduced by the feedback network of the operational amplifier A. For the rest of the circuit, comments similar to those described above also apply.

Figure 8:
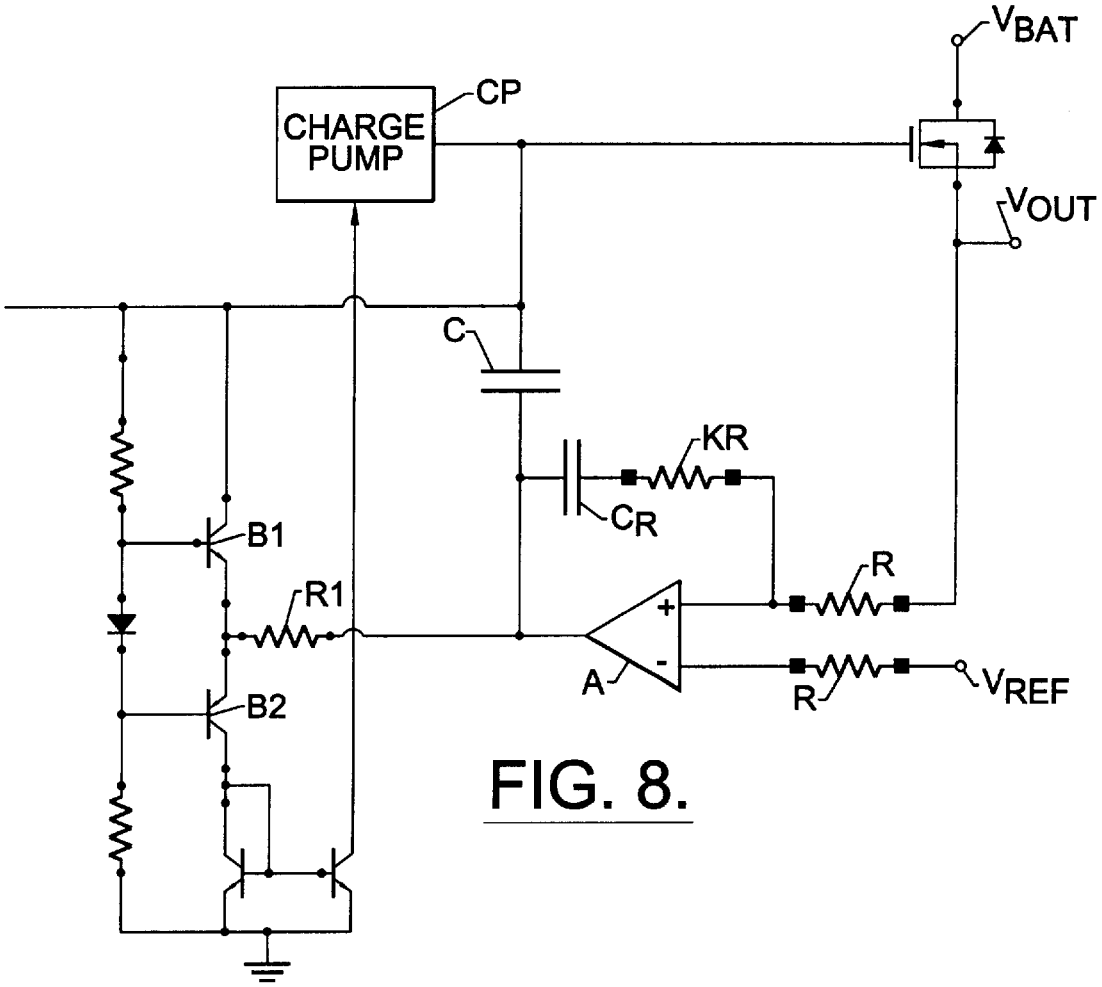
FIG. 8 is a diagram of a further alternative embodiment of the circuit according to the invention.

FIG. 8 shows in detail the current switch controlled by the operational amplifier A. The transistors B1 and B2 are polarized in a manner such that the output of the operational amplifier A is at a voltage of about Vref/2 to maximize the range. A resistor R1 is required to limit the current supplied to the charge pump CP by the output stage of the operational amplifier A.

A characteristic of MOS transistors is that they have a high parasitic capacitance between the gate terminal and the source terminal. The charge pump CP sends charge to the gate terminal in a pulsed manner which leads to interference which appears at the source terminal in the form of a voltage wave. The use of small capacitances and the switching-off of the charge pump CP in the steady state prevent this problem, while the wide-band feedback loop at the same time ensures a quick response of the regulator circuit to external stresses.

As can therefore be seen, the voltage-regulator circuit according to the present invention has various important advantages which will be summarized as follows. No storage capacitor is necessary in the charge pump CP, with a consequent saving of area. The regulator does not require a compensation capacitor. The dominant pole is created by utilization of the parasitic capacitances of the MOS power transistor PT. Independence from the pole introduced by the load is achieved without the need to limit the response speed of the regulator by overcompensation.

Naturally, the principles of the invention remaining the same, the details of construction and forms of embodiment may be varied widely with respect to those described and illustrated, without thereby departing from the scope of the present invention as defined in the annexed claims.

That which is claimed is:

1. A voltage-regulator circuit comprising:

a power transistor which is supplied with an input voltage for regulating an output voltage;

a voltage-raising circuit which is supplied with the input voltage for driving a control terminal of said power transistor;

a closed feedback control circuit cooperating with said power transistor and said voltage-raising circuit for defining a first feedback loop having high gain and low response speed, and a second feedback loop having low gain, wide passband, and quick response speed, said feedback control circuit operating based on a difference between a signal indicative of the output voltage and a reference voltage;

wherein said first feedback loop comprises:

a resistive divider for providing the signal indicative of the output voltage;

a first amplifier having a first input connected to said resistive divider, a second input connected to the reference voltage, and an output; and a second amplifier having an input connected to the output of said first amplifier and an output connected to said voltage-raising circuit.

2. A circuit according to claim 1, wherein said second feedback loop comprises a capacitor connected between the output of the first amplifier and a control terminal of the power transistor.

3. A circuit according to claim 2, wherein said power transistor has parasitic capacitance; and wherein the capacitor has a capacitance of the same order of magnitude as the parasitic capacitance of the power transistor.

4. A circuit according to claim 1, wherein the second amplifier comprises a transconductance operational amplifier.

5. A circuit according to claim 1, wherein said closed loop feedback control circuit further comprises a circuit for driving the voltage-raising circuit and for switching off the voltage-raising circuit when the output voltage is in a steady state.

6. A circuit according to claim 1, wherein said voltage-raising circuit comprises a voltage tripler circuit.

7. A voltage-regulator circuit comprising:

a power transistor which is supplied with an input voltage for regulating an output voltage;

a voltage-raising circuit which is supplied with the input voltage for driving a control terminal of said power transistor; and a closed feedback control circuit cooperating with said power transistor and said voltage-raising circuit for defining a first feedback loop and a second feedback loop and operating based on a difference between a signal indicative of the output voltage and a referene voltage;

said first feedback loop comprising a resistive divider for providing the signal indicative of the output voltage, a first amplifier having a first input connected to said resistive divider, a second input connected to the reference voltage, and an output, and a second amplifier having an input connected to the output of said first amplifier and an output connected to said voltage-raising circuit;

said second feedback loop further comprising a capacitor connected between the output of the first amplifier and a control terminal of the power transistor.

8. A circuit according to claim 7, wherein said power transistor has parasitic capacitance; and wherein the capacitor has a capacitance of the same order of magnitude as the parasitic capacitance of the power transistor.

9. A circuit according to claim 7, wherein the second amplifier comprises a transconductance operational amplifier.

10. A circuit according to claim 7, wherein said closed loop feedback control circuit further comprises a circuit for driving the voltage-raising circuit and for switching off the voltage-raising circuit when the output voltage is in a steady state.

11. A circuit according to claim 7, wherein said voltage-raising circuit comprises a voltage tripler circuit.

12. A method for providing closed loop feedback control for a power transistor to provide voltage regulation and comprising the steps of supplying the power transistor with an input voltage for regulating an output voltage, supplying a voltage-raising circuit with an input voltage for driving a control terminal of the power transistor, such that the voltage-raising circuit operates based upon a difference between a signal indicative of the output voltage and a reference voltage providing first circuit portions for defining a first feedback loop cooperating with said power transistor and said voltage-raising circuit so as to have high gain and low response speed;

providing second circuit portions for defining a second feedback loop cooperating with said power transistor and said voltage-raising circuit so as to have low gain, wide passband, and quick response speed;

providing a resistive divider for detecting the signal indicative of the output voltage;

providing a first amplifier having a first input connected to said resistive divider, a second input connected to the reference voltage, and an output; and providing a second amplifier having an input connected to the output of said first amplifier and an output connected to said voltage-raising circuit.

13. A method according to claim 12, wherein the step of providing the second circuit portions comprises providing a capacitor connected between the output of the first amplifier and a control terminal of the power transistor.

14. A method according to claim 12, further comprising the step of providing third circuit portions for driving the voltage-raising circuit and for switching off the voltage-raising circuit when the output voltage is in a steady state.

* * * * *

UNITED STATES PATENT AND TRADEMARK OFFICE

CERTIFICATE OF CORRECTION

PATENT NO. : 6,040,736

DATED : March 21, 2000

INVENTOR(S) : Milanesi et al

It is certified that error appears in the above-identified patent and that said Letters Patent is hereby corrected as shown below:

On the title page:

Item [75] Inventors

Delete:
"Leghorn"

Substitute:
- - Livorno - -

Item [73] Assignees

Delete:
"Arate"

Substitute:
- - Agrate - -

Signed and Sealed this

Thirtieth Day of January, 2001

*Attest:*

Q. TODD DICKINSON

*Attesting Officer*

*Director of Patents and Trademarks*